United States Patent [19]

Fabregue

[11] Patent Number: 4,515,748

[45] Date of Patent: May 7, 1985

[54] APPARATUS FOR DETECTION OF LOSSES IN A VAPOR GENERATOR

[75] Inventor: Jean-Pierre Fabregue, Athis-Mons, France

[73] Assignee: ELECTRICITE DE FRANCE Service National, Paris, France

[21] Appl. No.: 396,439

[22] Filed: Jul. 8, 1982

[30] Foreign Application Priority Data

Jul. 8, 1981 [FR] France ..... 81 13427

[51] Int. Cl.[3] ..... G21C 17/00; F28F 11/00

[52] U.S. Cl. ..... 376/250; 165/11 R

[58] Field of Search ..... 376/250; 165/11 R, 11 A; 73/40, 40.5 R, 40.7

[56] References Cited

U.S. PATENT DOCUMENTS

| | | | |
|---|---|---|---|
| T.955,004 | 2/1977 | Sayre | 376/250 |
| 3,803,900 | 4/1974 | Maillard | 376/250 |
| 3,975,943 | 8/1976 | Brachet | 376/250 |
| 4,090,554 | 5/1978 | Dikinsow | 165/11 |
| 4,216,821 | 8/1980 | Robin | 376/250 |
| 4,311,189 | 11/1982 | Robin | 165/11 R |

FOREIGN PATENT DOCUMENTS

| | | |
|---|---|---|
| 2129508 | 10/1972 | France . |
| 2287668 | 5/1976 | France . |

*Primary Examiner*—Sal Cangialosi

*Attorney, Agent, or Firm*—Kerkam, Stowell, Kondracki & Clarke

[57] ABSTRACT

Device for the detection of leaks by sampling liquid sodium in a steam generator.

The sodium sampling means is constituted by a tubular collector placed in the protection space on the periphery of the tube plate and along which are distributed a plurality of sampling openings, while a plurality of ducts issue at one end into the protection space and at the other end into the sodium circulation enclosure.

7 Claims, 3 Drawing Figures

APPARATUS FOR DETECTION OF LOSSES IN A VAPOR GENERATOR

Figure 1:
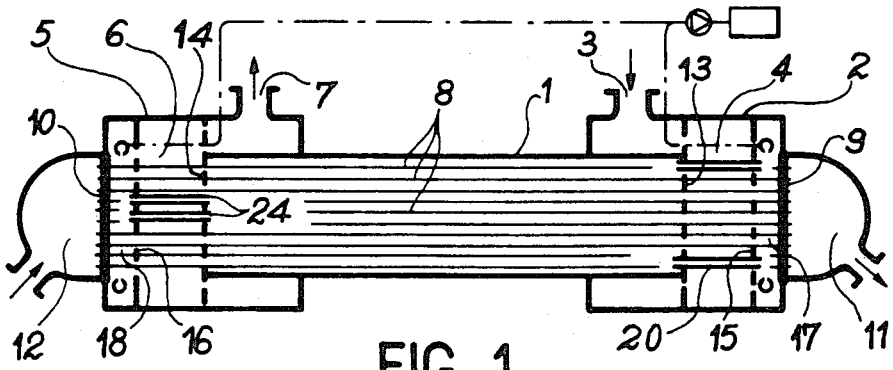

The invention relates to a device for detecting leaks in a steam generator.

In electric power stations, a boiler supplies heat to the fluid of a primary circuit, which then circulates in a steam generator in order to yield its heat to the water of a secondary circuit, which is transformed into steam, the latter then being passed into turbines.

In nuclear power stations, e.g. of the fast neutron type, it is known to use liquid sodium as the primary fluid. In this case, the steam generator is constituted by a heat exchanger, whose primary circuit contains liquid sodium and whose secondary circuit contains water transformed into steam.

In the case of such steam generators, special precautions must be taken to prevent any contact between the liquid sodium of the primary circuit and the water of the secondary circuit. Thus, it is known that the mixing of sodium and water at high temperatures leaks to chemical reactions, which give off gases. If such phenomena occur in the steam generator, the resulting overpressures are liable to lead to its destruction. It is therefore particularly important to detect, during the operation of the generator, the smallest possible leak which might occur between the primary circuit and the secondary circuit.

In such steam generators, it is known to continuously sample the liquid sodium, followed by a chemical analysis to establish whether a quantity of water, even a very small quantity has entered the liquid sodium as a result of a leak. The analysis consists of detecting the presence of hydrogen in the sodium, which reveals the introduction of water.

Steam generators of the "sodium - water" type, generally comprise a primary circuit for secondary liquid sodium constituted by a plurality of tubes immersed in the liquid sodium and welded to tube plates. The water introduced into these tubes is transformed into steam. In this case, there is a danger of leaks at the welds connecting the tubes to the tube plates. A known leak detection device analysis the liquid sodium sampled in the vicinity of the tube plates. During this sampling, a problem is encountered due to the fact that the sodium circulates at high- speed causing a considerable dilution of the chemical products present in the sodium during the appearance of a leak. Another difficulty results from the fact that the sodium is sampled at the tube plates, where the presence of a large number of tubes in the space prevents the introduction of a device able to sample the sodium at any point on said tube plates. Therefore, the known liquid sodium sampling devices for the detection of leaks are relatively ineffective and are also complicated.

The present invention proposes a new design of leak detection device eliminating the aforementioned disadvantages.

The present invention more particularly relates to a device for the detection of leaks by sampling the liquid sodium contained in a steam generator comprising a primary circuit constituted by an enclosure for the circulation of sodium between a sodium introduction chamber and a sodium discharge chamber, each chamber being bounded on the side of the circulation enclosure by a sodium distribution grid, and on the other side by a tube plate provided with a heat shield parallel to the tube plate and spaced therefrom by a space for confining a volume of liquid sodium for protectiug the tube plate against heat shocks, and a secondary circuit constituted by a plurality of water circulating tubes sealingly fixed at their two ends to tube plates and issuing, on the other side thereof, respectively into a steam discharge chamber and a water supply chamber. The end parts of the tubes respectively pass into the sodium introduction and discharge chambers, whilst non-sealingly traversing on the one hand the distribution grid and on the other the heat shield corresponding thereto. The detection device comprises means for the continuous sampling and analysis of a certain quantity of the confined liquid sodium in the space providing protection against thermal shocks.

According to an essential feature of the invention, the confined sodium sampling means comprises at least one tubular collector placed in the protection space, on the periphery of the tube plate and along which are distributed a plurality of sampling holes, and a plurality of ducts issuing at one end into the protection space and at the other end into the sodium circulation enclosure. In the protection space, these ducts bring about a circulation of the liquid sodium from the centre of said space towards the periphery, in the direction of the tubular collector.

According to an embodiment of the invention the sampling means is placed in the protection space corresponding to the sodium introduction chamber and the ducts causing the circulation of the sodium issue into said protection space in the vicinity of the tube plate periphery.

According to another embodiment of the invention, the sampling means is placed in the protection space corresponding to the sodium discharge chamber and the ducts causing the circulation of the sodium issue into said protection space in the vicinity of the centre of the tube plate.

The invention is described in greater detail hereinafter relative to non-limitative embodiments and the attached drawings, wherein show:

FIG. 1 a diagrammatic section of a steam generator equipped with a detection device according to the invention.

Figure 2:
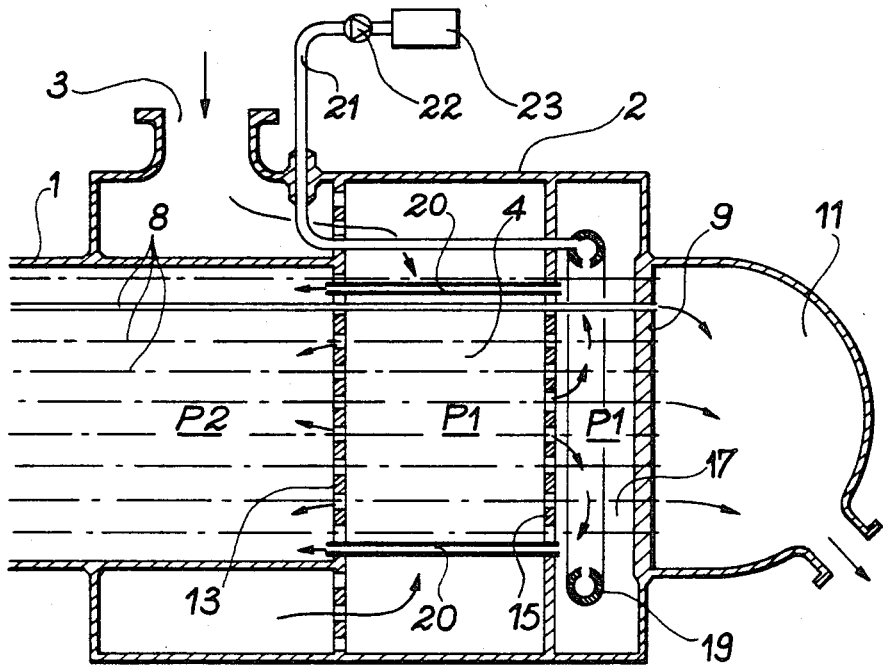

FIG. 2 a larger scale section of that part of the steam generator located to the right in FIG. 1.

Figure 3:
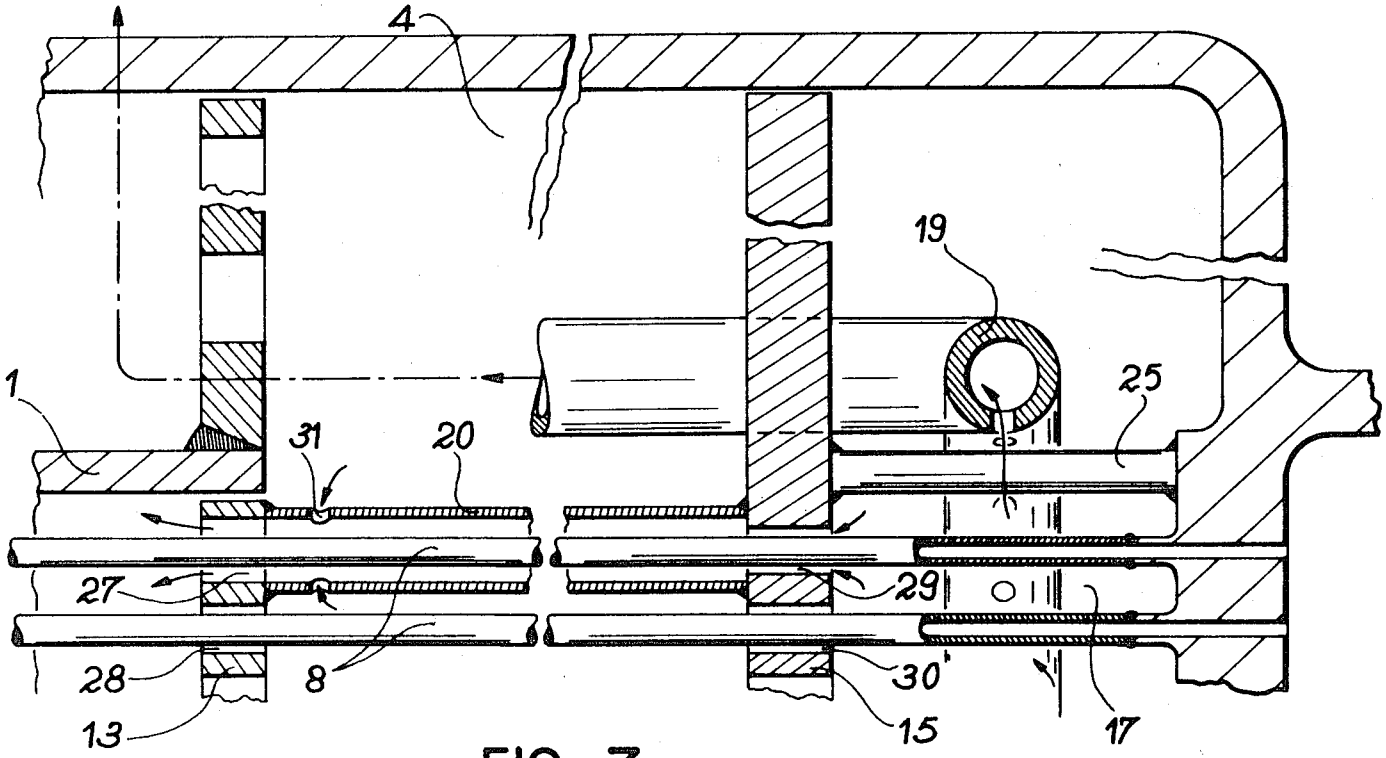

FIG. 3 a partial section, in the same plane as FIG. 2, showing a special embodiment of the invention.

With reference to FIG. 1, it is possible to see a "sodium - water" steam generator, which comprises an elongated cylindrical enclosure 1 filled with circulating liquid sodium constituting the primary circuit. To one end of the enclosure is sealingly fixed a closed cylindrical envelope 2 provided with a liquid sodium inlet 3 and defining an introduction chamber 4. To the other end of cylindrical enclosure 1 is sealingly fixed a closed cylindrical envelope 5 provided with a liquid sodium outlet 7 and defining a discharge chamber 6. The liquid sodium constituting the primary circuit of this steam generator completely fills the space defined by the closed envelope 2, cylindrical enclosure 1 and closed envelope 5.

The liquid sodium heated by the primary exchangers of the nuclear reactor enter cylindrical enclosure 1 via introduction chamber 4, yields its heat to a secondary circuit located within enclosure 1 and then leaves via discharge chamber 6, returning to the primary exchangers of the nuclear reactor. The secondary circuit located within the cylindrical enclosure 1 comprises a plurality of straight tubes 8 arranged parallel to the longitudinal axis of the cylindrical enclosure 1 and which are regularly spaced from one another. These tubes traverse the complete interior of the cylindrical envelope 1, as well as the introduction chamber 4 and discharge chamber 6. The ends of these tubes are connected on either side to two tube plates 9, 10 forming the tight bottom of the closed cylindrical envelopes 2 and 5. The faces opposite to the tubes of tube plates 9, 10 are linked with chambers 11, 12. The secondary water circuit is established in the following way. The water is introduced by introduction chamber 12 into tubes 8 and located on the side of the sodium discharge chamber 6, is converted into steam due to the hot liquid sodium surrounding tubes 8 and leaves the latter by discharge chamber 11 located on the side of the liquid sodium introduction chamber 4. This steam generator also comprises grids 13, 14 respectively applied to the inlet and outlet of cylindrical enclosure 1 and which are intended to bring about a uniform distribution of the liquid sodium flow circulating within enclosure 1 in order that this liquid sodium yields substantially the same quantity of heat to all the tubes 8. This generator also comprises heat shields 15, 16 located respectively in sodium introduction chamber 4 and sodium discharge chamber 6 and arranged respectively in parallel and at a short distance from tube plates 9 and 10. The heat shields 15, 16 have a plurality of tube passages and are consequently not liquid sodium-tight. However, they significantly limit the circulation of the liquid sodium contained in the space between the heat shields and the corresponding tube plate. Thus, spaces 17, 18 contain liquid sodium only circulating to a limited extent and which is consequently substantially confined, so as to protect tube plates 9, 10 against thermal shocks.

FIG. 2, which is a larger scale view of the part to the right in FIG. 1, shows the liquid sodium introduction chamber 4, the space 17 for protecting against thermal shocks and steam discharge chamber 11. It also shows means constituting the leak detection device forming the object of the present invention and which will now be described. This leak detection device comprises a sampling device located in the vicinity of the tube plate 9 in order to carry out the analysis of the liquid sodium in contact with the welds Joining tubes 8 to the tube plate 9.

The sampling device is constituted by a tubular collector 19, shaped like a torus and located within the protection space 17 at a limited distance from tube plate 9 and level with the periphery thereof. Thus, all the tubes 8 are located within collector 19. Collector 19 is provided with a plurality of uniformly distributed sampling openings arranged radially towards the inside, whilst collector 19 is also connected by a group of pipes 21 to a pump outside steam generator 22 which transfers the sampled liquid sodium into a unit 23 for chemically analysing the sodium with a view to determining whether water has been introduced into it during the operation of the generator.

The device for the detection of leaks by sampling sodium also comprises a plurality of ducts 20 providing a link between protection space 17 and the interior of cylindrical chamber 1. These ducts consequently traverse at one end the heat shield 15 and at the other end the distribution grid 13.

The liquid sodium sampling device functions as follows. If a leak occurs at the weld linking one of the tubes 8 with tube plate 9, due to the fact that the pressure of the secondary circuit is well above the pressure of the primary circuit, said leak causes water or steam to be introduced into the liquid sodium at tube plate 9. Thus, the liquid sodium containing this water is located in protection space 17. As this liquid sodium is confined in this space, it is appropriate to sample the sodium contained in this space because the leak-revealing impurities are not immediately diluted in the totality of the sodium constituting the primary circuit. In order to understand the operation of the sampling device, it is necessary to make a balance of the different pressures in the different chambers constituting the primary circuit of this generator. Liquid sodium enters chamber 4 at a pressure P1. When it passes through distribution grid 13, it produces a pressure drop and within cylindrical enclosure 1 there is a pressure P2, which is below P1. As there is substantially no liquid sodium flow through heat shield 15 between introduction chamber 4 and protection space 17, the pressure in the latter is the same as in chamber 4, i.e. P1. Thus, due to the pressure differences, the peripheral ducts 20 linking protection space 17 and the interior of cylindrical chamber 1, lead to a passage of sodium from introduction chamber 4 to protection space 17 in the vicinity of the centre of the heat shield and consequently a radially outwardly directed displacement of the sodium contained in space 17, followed by its discharge via ducts 20 in the direction of the interior of enclosure 1. If a leak occurs at a random point on the tube plate, the sodium containing the impurities due to this leak will move radially outwards into space 17 and will then rapidly reach the tubular collector located at the periphery of said plate and at a limited distance from ducts 20. Pump 22 will then suck in this liquid sodium containing these impurities and it will be possible to analyse the sodium in unit 23 and reveal the existence of a leak. The device has the advantage of operating continuously throughout the operation of the steam generator.

A description has been provided of the sodium sampling device corresponding to tube plate 9 located on the side of the sodium introduction chamber 4. In similar manner according to the invention, it is possible to sample the liquid sodium at tube plate 10 located on the side of discharge chamber 6. For this purpose, reference should be made to FIG. 1. The second sampling device operates in the same way as the first. It comprises a tubular collector positioned in the protection space at the periphery of the tube plate, in the same way as described hereinbefore. There are ducts 24 connecting the protection space and the interior of cylindrical enclosure 1. The only difference is that the ducts 24 are arranged so as to issue into the central area of the protection space. Thus, due to the fact that the sodium circulates through a grid 14 from the interior of cylindrical chamber 1 to discharge chamber 6, chambers 18 and 6 are at a pressure below the pressure within the enclosure 1. Therefore, to bring about a displacement of the sodium from the centre of the space towards the peripheral area of the protection space, it is necessary to bring about an overpressure in the centre thereof with the aid of ducts 24, which explains the positioning difference of the latter.

FIG. 4 shows a special embodiment of a sodium sampling device according to the invention. This part section is located in the steam generator in the area extending from the distribution grid to the tube plate, in the peripheral area mainly housing the tubular collector and the circulation ducts. It is possible to see the end of cylindrical enclosure 1 to which is radially fixed a distribution grid 13. It is also possible to see the tube plate 9 arranged parallel to grid 13. Between grid 13 and plate 9 is positioned the sodium introduction chamber 4 and parallel and at a limited distance from plate 9, a heat shield 15 defining therewith and with tube plate 9 a protection space 17. It is also possible to see tubes 8 arranged in longitudinal manner and welded to tube plate 9. Tubular collector 19 located at the periphery of the tube plate is held rigidly in place by supporting elements 25, which also rigidly secure the heat shield 15. The circulation ducts 20 positioned at the periphery of the tube plate are arranged concentrically around certain of the tubes 8 positioned at the periphery of the tube plate. These ducts 20 are sealingly welded to the faces of grid 13 and shield 15, which are in contact with introduction chamber 4. There is an annular space 26 between the ducts and their corresponding concentric tubes. The normal tubes 8 or those surrounded by a duct 20 successively traverse distribution grid 13 and heat shield 15, whilst passing through openings made in the grid and shield. The openings have a diameter larger than the external diameter of tubes 8, so that the liquid sodium can pass through the annular space left between the openings and the tubes. It is pointed out that the openings 27 of the distribution grid 13 corresponding to the tube surrounded by a duct 20 have a diameter larger than the openings 28 of the distribution grid 13 corresponding to the other tubes. The function of this diameter difference is to compensate the pressure drop produced by duct 20 in such a way as to ensure that the liquid sodium flow passing out of openings 27 into enclosure 1 is identical to the flow passing out of the other openings 28 into the same enclosure 1.

If the constructional arrangements of openings 27 and 28 do not maintain a perfectly uniform distribution of the sodium flows traversing the grid at any point, it is possible to provide small openings 31 on ducts 20, which bring about a slight communication between chamber 4 and the interior of said ducts 20 in order to slightly modify the sodium flow circulating in these ducts. Instead, of placing ducts 20 around tubes 8, they can also be positioned between said tubes 8.

The liquid sodium circuit is established in the following way. The sodium of chamber 4 passes through the central area of shield 15 through the annular space defined by openings 30 and then travels radially towards the outside of chamber 17, passes out of the latter through the annular space left by openings 29, circulates in duct 20 and passes back into enclosure 1 through the annular space left by openings 27. At the same time, tubular collector 19 permanently sucks in part of the sodium travelling towards the outside of chamber 17. This sodium is then brought by small tubes to the outside of the steam generator and is chemically analysed.

In the embodiment of FIG. 3, the distribution grid 13 is not directly fixed to the cylindrical enclosure 1. Instead, it is rigidly fixed by welding to the ducts 20, which are themselves fixed to the heat shield 15, which is welded by spacers 25 around tube plate 9. Thus, ducts 20 act as spacers. Thus, expansions resulting from temperature variations permit a certain displacement of distribution grid 13 relative to the end of enclosure 1, thus preventing stresses in the structure.

The invention is not limited to the embodiment illustrated in FIG. 3 or to the type of steam generator illustrated in FIG. 1. Without passing beyond the scope of the invention, it can be applied to other types of steam generators, namely those having helical tubes or U-shaped tubes.

What is claimed is:

1. A device for the detection of leaks by sampling liquid sodium in a steam generator comprising a primary circuit constituted by an enclosure for circulating sodium between an introduction chamber and a discharge chamber, each chamber being bounded on the side of the circulation enclosure by a sodium distribution grid and on the other side by a tube plate, provided with a heat shield parallel to the tube plate and spaced therefrom by a space for the confinement of a volume of sodium for protecting the tube plate against thermal shocks, and a secondary circuit constituted by a plurality of water circulation tubes sealingly fixed at both their ends to the tube plates and issuing on the other side thereof respectively into a water supply chamber, the end portions of said tubes passing into each of the sodium introduction and discharge chambers, whilst non-sealingly traversing on the one hand the distribution chamber and on the other the heat shield corresponding thereto, the detection device comprising means for the continuous sampling and analysis of a certain quantity of confined sodium located in the protection space, wherein the confined sodium sampling means is constituted by at least one tubular collector placed in the protection space on the periphery of the tube plate and along which are distributed a plurality of sampling openings, and a plurality of ducts issuing at one end into the protection space and at the other end into the sodium circulation enclosure, whereby in the protection space the ducts circulate the liquid sodium from the centre of said space towards its periphery.

2. A leak detection device according to claim 1, wherein the sampling means is placed in the protection space corresponding to the sodium introduction chamber and the ducts bringing about the circulation of the sodium issue into the detection space in the vicinity of the periphery of the tube plate.

3. A leak detection device according to claims 1 or 2, wherein the sampling means is placed in the protection space corresponding to the sodium discharge chamber and the ducts bringing about the circulation of the sodium issue into the protection space in the vicinity of the centre of the tube plate.

4. A leak detection device according to claims 2 or 3, wherein the ducts bringing about the circulation of the sodium are arranged perpendicular to both the distribution grid and the heat shield and sealingly traverse the distribution grid and the heat shield, whilst being positioned longitudinally between the tubes of the secondary circuit.

5. A leak detection device according to claims 2 or 3, wherein the ducts bringing about the circulation of the sodium are arranged perpendicular both to the distribution grid and the heat shield and sealingly connect the heat shield and the distribution grid, whilst being positioned concentrically about certain tubes of the secondary circuit, the sodium circulating in these ducts passing through the grid and the shield in the space existing between the corresponding tube and the grid or shield, as well as the annular space left between the tube and surrounding duct.

6. A leak detection device according to claim 5, wherein the openings in the grid permitting the passage of tubes surrounded by one of the circulation ducts leave an annular passage larger than that existing between the openings of the grid permitting the passage of the other tubes, in order to keep constant the sodium flow traversing the distribution grid at any point thereof, including the locations incorporating the circulation ducts.

7. A leak detection device according to claim 6, wherein there are also small openings on the circulation ducts level with the sodium introduction or discharge chamber and serving to slightly modify the sodium flow traversing these ducts in order to more accurately regulate the sodium flow traversing the grid in such a way that it is identical at any point.

* * * * *